US012484675B1

(12) United States Patent
Zawistowski

(10) Patent No.: US 12,484,675 B1
(45) Date of Patent: Dec. 2, 2025

(54) CELL PHONE STORAGE COMPARTMENT EMBEDDED IN LUGGAGE

(71) Applicant: Glenn Zawistowski, Jacksonville, FL (US)

(72) Inventor: Glenn Zawistowski, Jacksonville, FL (US)

( * ) Notice: Subject to any disclaimer, the term of this patent is extended or adjusted under 35 U.S.C. 154(b) by 0 days.

(21) Appl. No.: 19/072,305

(22) Filed: Mar. 6, 2025

(51) Int. Cl.
*A45C 13/28* (2006.01)
*A45C 5/03* (2006.01)
*A45C 13/26* (2006.01)

(52) U.S. Cl.
CPC ..... *A45C 13/28* (2013.01); *A45C 5/03* (2013.01); *A45C 13/262* (2013.01); *A45C 2013/267* (2013.01)

(58) Field of Classification Search
CPC ..... A45C 13/28; A45C 5/03; A45C 13/262; A45C 2013/267
USPC ..... 190/102
See application file for complete search history.

(56) References Cited

U.S. PATENT DOCUMENTS

2011/0031287 A1* 2/2011 Le Gette ..... H04R 1/02 248/65
2018/0049524 A1* 2/2018 Yu ..... A45C 13/262

FOREIGN PATENT DOCUMENTS

CN 110150814 A * 9/2019

* cited by examiner

*Primary Examiner* — Nathan J Jennes
*Assistant Examiner* — Jessica Kavini Tamil
(74) *Attorney, Agent, or Firm* — Lawrence J. Gibney

(57) ABSTRACT

A cell phone is a modern day feature, and many people are never very far apart from their cell phone, particularly while traveling. Modern day luggage usually consists of a cubic structure with defined rigid side wall with rollers on the bottom edge and a luggage handle that telescopes. This device would be secured to the interior sides of the telescoping handles and when the telescoping handles are collapsed, the storage case remains in the piece of luggage with the cell phone securely in place, protected by the luggage. When the cell phone needs to be retrieved, the user would extend the telescoping handles and the storage case would be readily available.

3 Claims, 5 Drawing Sheets

CELL PHONE STORAGE COMPARTMENT EMBEDDED IN LUGGAGE

A. FIELD OF THE INVENTION

The portable electronic device (PED) and specifically the cellular phone is a ubiquitous feature of modern society. According to recent data there are over seven billion cell phones worldwide. The modern cell phone is a lifeline of sorts for many people. The device stores a person's contacts, including addresses and important dates such as birthdays and anniversaries and many people feel lost without their cell phone. The modern cell phone is ideal for traveling because they are lightweight and are designed to be portable. When people travel an airline ticket is often on the person's cell phone and any loss of data or any damage to the cell phone that would make is unusable would force the person to obtain a paper ticket; this would be an inconvenience for the modern traveler. Many people do not travel without their cell phone, particularly when traveling long distances, such as on airplanes.

Many people have luggage with rollers on one end and a pair of telescoping handles on the other end. In this application a storage case would be attached to the interior of the telescoping handles. The individual would be able to store the cell phone in the luggage when it is not in use; this would prevent damage to the cell phone during normal transit in the airport but allow easy access to the phone when it is needed.

B. PRIOR ART

There are prior art references that discuss storage compartments and specifically for luggage. A representative example of this can be found at Chehebar, U.S. Pat. No. 9,198,492. This device is a luggage system which has a method to store clothing. This does not specifically relate to the storage of a portable electronic device; however, it does illustrate a type of storage device in a piece of luggage.

Another reference can be found in Warther, U.S. Pat. No. 9,224,084. The Warther device is a smart tag device or a programmable electronic luggage tag. It does not specifically describe a compartment to hold a portable electronic device, but it does illustrate some of the technology in this area as it relates to luggage. Another prior art reference can be found at Shiekh, U.S. Pat. No. 9,778,084 which is a smart luggage system having a case assembly with a first storage compartment and then a second storage compartment. The first and second lock assemblies pertain to the first and second storage compartments in a closed and locked orientation. The smart handle assembly includes a control having a wireless communication interface and further includes a power supply. Another reference in the prior art can be found in Nichols, U.S. U.S. Pat. No. 11,517,086. The Nichols reference is a suitcase having a base and a lid, where the lid may be rotatable. The lid may comprise an upper shell and the base may comprise the lower shell. The upper shell and lower shell may be seamlessly formed to create a water resistant and/or waterproof suitcase. Another reference that can be found in the prior art includes Lewis, U.S. Publication 2006/0207850. The Lewis reference is a luggage handle with interval weight scale. The Lewis reference does not discuss a compartment but discusses the technology regarding luggage and luggage devices.

None of the prior art references claim the features present in the current application.

BRIEF SUMMARY OF THE INVENTION

In airports today many people traveling with rolling luggage also hold their cell phone in the hand that is not pulling or pushing the rolling luggage. It is not at all uncommon to see an individual using one hand rolling the luggage and holding a paper or a beverage in the other hand. This is particularly important when the person is escorting a child through a busy airport. The use of the cell phone can accomplish many tasks, including calling an individual or looking up data or finding an airline ticket. Without this device, a person would carry the cell phone in their hand, or in a pocket, or a purse and retrieval of a cell phone can become problematic. Because the person knows at all times where the cell phone is located, the person can escort the child or carry the beverage with the free hand while at the same time having easy access to the cell phone with this device.

In the situation of an airport easy access to a cell phone is critical to ensure that the traveler is provided valuable real time information. For instance, airlines change gates of departure on a routine basis and this type of information is critical particularly in situations where the traveler must find the appropriate gate of departure especially if there is little time to travel between gates or terminals. This device would allow the person to always have access to this information.

This device is an embedded compartment in a piece of luggage that can safely stow a cell phone. Many of the rolling luggage devices have telescoping handles and an attachment to the interior of the telescoping handles would secure the device to the interior.

If the telescoping handles are completely flush with the top surface of the luggage, the device with the cell phone would be embedded in the luggage itself. A flap can be created in the top surface of the luggage that will allow the luggage handles to retract into the luggage.

When the individual pulls up on the luggage handles, the storage container for the phone would move up with the telescoping handles to expose the container that holds the phone. The holder of the phone that is part of this device will also tilt so that the person can always have the phone within easy reach but also allow the individual to position the phone to the best possible configuration for ease of communication. For instance, if the person is sitting waiting on a flight and decides to call a family member to update that person, the person could simply tilt the phone and either call the person or Facetime the person.

The container should be made with durable material and it should be anticipated this device will fall and possibly incur 2 some damage. Appropriate protection will be provided to protect the phone.

NUMBERING REFERENCE

Figure 1:
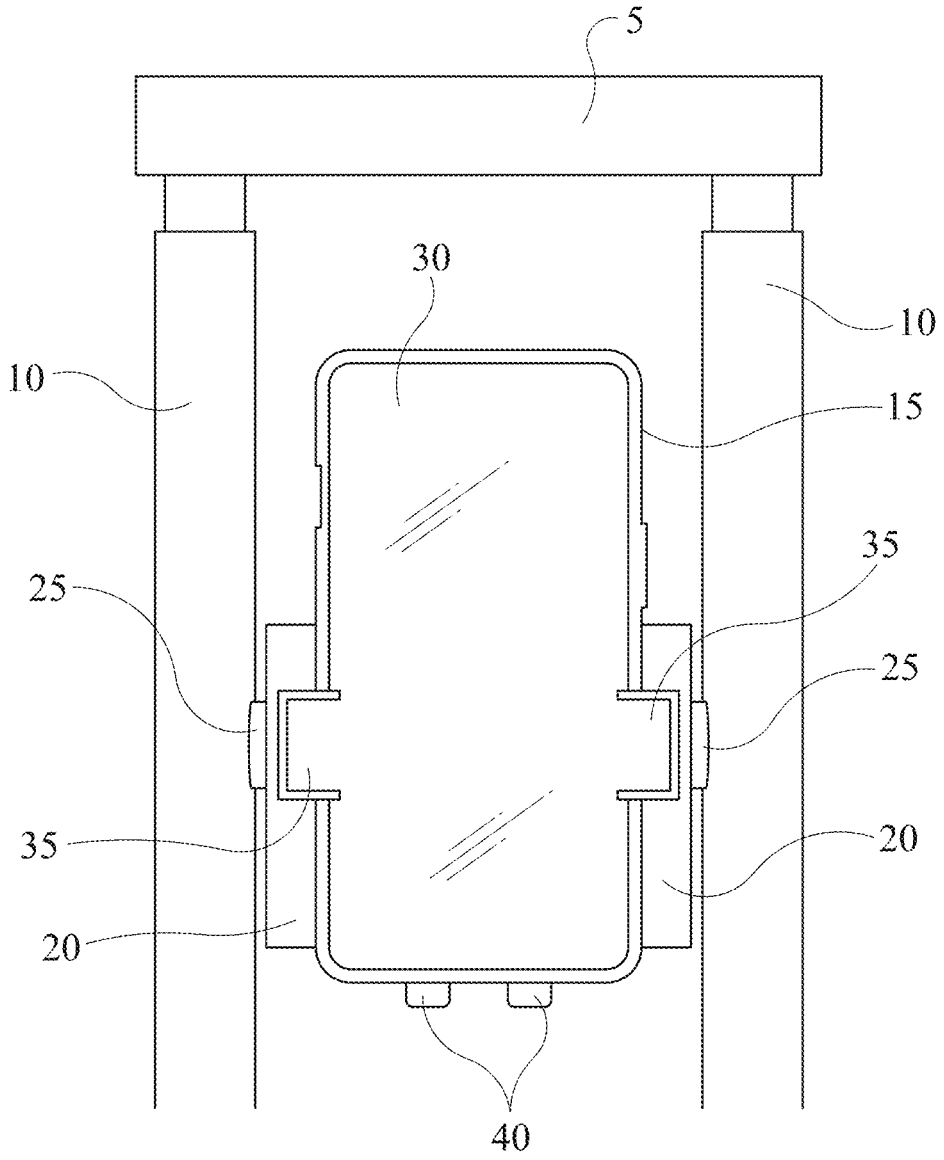
FIG. 1 is a front view of the portable electronic device secured to the cell phone holder that is secured to the telescoping handles of luggage.
Figure 2:
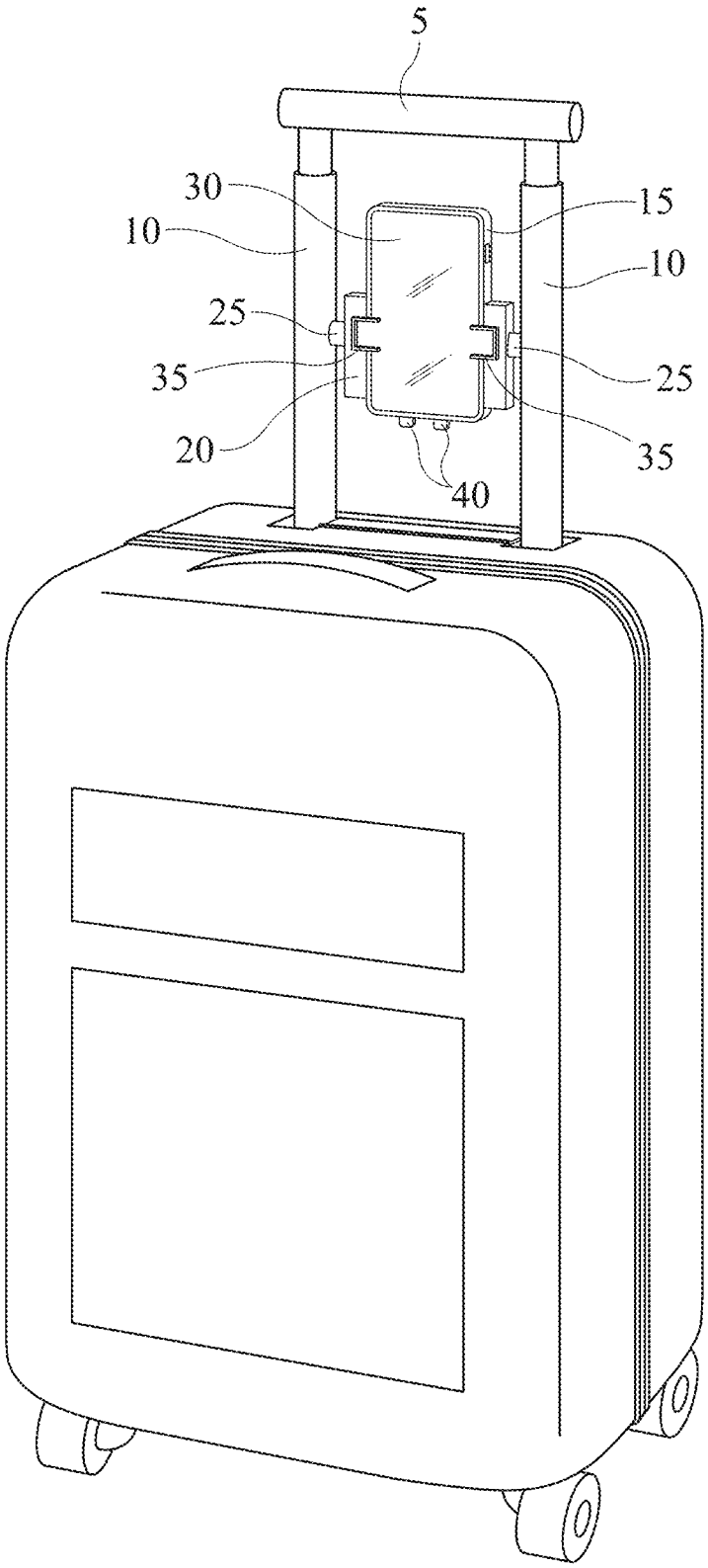
FIG. 2 is a front isometric view of a piece of luggage and telescoping handles depicting the location of the cell phone holder with the handles extended.
Figure 3A:
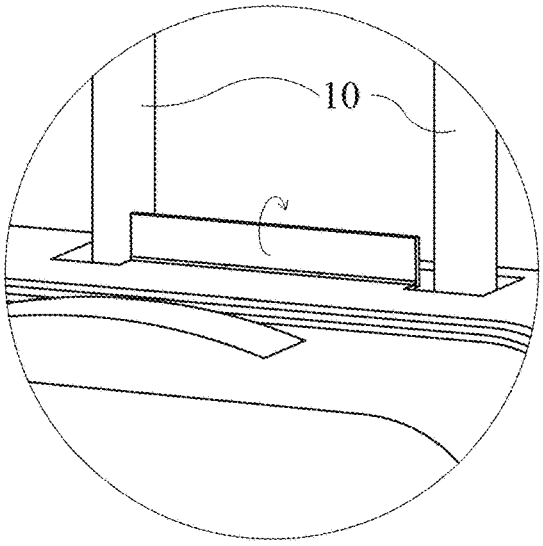
FIG. 3 is a front isometric view of a piece of luggage with the telescoping handles flush with the top of the luggage.
Figure 3B:
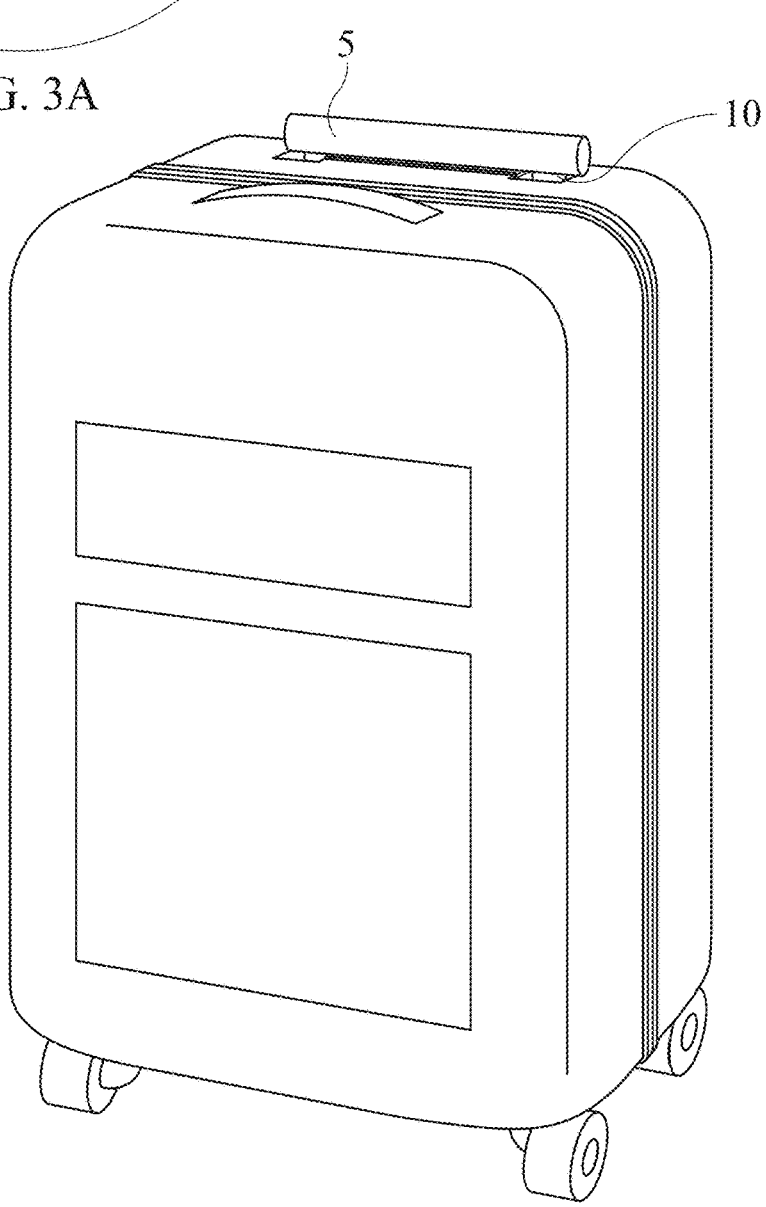

1 Luggage
5 Luggage Handle

10 Telescoping Handles
15 Phone Cover
20 Phone Holder
25 Rotate Mechanism
30 Phone
35 Side Clamps
40 Leg Clamps
45 Flap

DETAILED DESCRIPTION OF THE EMBODIMENTS

A portable electronic device (PED) is a common feature of society. In this application the PED will focus on the cell phone, which is routinely carried by individuals wherever they may travel. It is not uncommon to have the PED stowed in a pocket, a purse, or a backpack.

PEDs store a multitude of information such as addresses, phone numbers and emails of friends and family. Through the use of "apps" that are downloaded on the phone, individuals can store concert tickets, sports tickets, credit card information, and even airline tickets or bus tickets. The importance of the portable electronic device will become even more important as society transitions to a more "paperless" world. Airline tickets, concert tickets and sporting event tickets are becoming more and more linked to a digital version of the ticket that is stored on a person's phone. Consequently, the loss of the use or damage to a PED such as a cell phone would cause a major inconvenience to the individual.

When an individual is traveling in an airport, the individual is usually pulling or pulling a piece of luggage, that is usually rectangular with wheels on the bottom surface of the luggage with defined sides, which are usually rigid. The luggage can come in different shapes and sizes and colors but the luggage itself is a common item that is used by the traveler.

In the example of a person in an airport, the person must go from one terminal or one gate to another terminal or gate as he or she is pulling or pushing a piece of luggage. Wheels are usually on the bottom of the piece of luggage, but it does take at least one hand to grab the handle of the luggage and push or pull the piece of luggage. With most luggage pieces a pair of telescoping handles are provided. The telescoping handles extend a distance to make it comfortable to push or pull the luggage. When the telescoping handles are no longer needed or need to be stored back into the luggage, the telescoping handles are stowed in the luggage with the luggage handles flush against the top of the surface.

As the person uses one hand to grab the handle of the piece of luggage, the other hand is frequently holding a cell phone as the person travels through the airport. If the person is not holding his or her cell phone, it is stored in a pocket or purse.

With this device the cell phone can be stowed within the luggage compartment 1 in a protected shell to prevent damage to the cell phone. With the handle 5 flush against the top surface of the luggage, the cell phone 30 is safely stowed within the luggage compartment.

As the person extends the telescoping handles 10, the device that holds the cell phone 30 is exposed. The person can safely and securely stow the cell phone 30 on this holder 20, which is connected to the inner sides of the telescoping handles 10.

Clamps will be provided on the sides of the device as well as the bottom of the holder 20 to securely stow the cell phone on the holder 20 such as depicted in FIG. 1. The holder 20 will also rotate 25 and lock in place if desired by the user.

An opening or flap 45 will be provided on the top surface of the luggage between the telescoping handles. The opening of or flap 45 will open as the holder 20 is pushed into the interior of the luggage and open when the person pulls up on the handle to allow the holder 20 to be safely stored within the luggage compartment.

Figure 4:
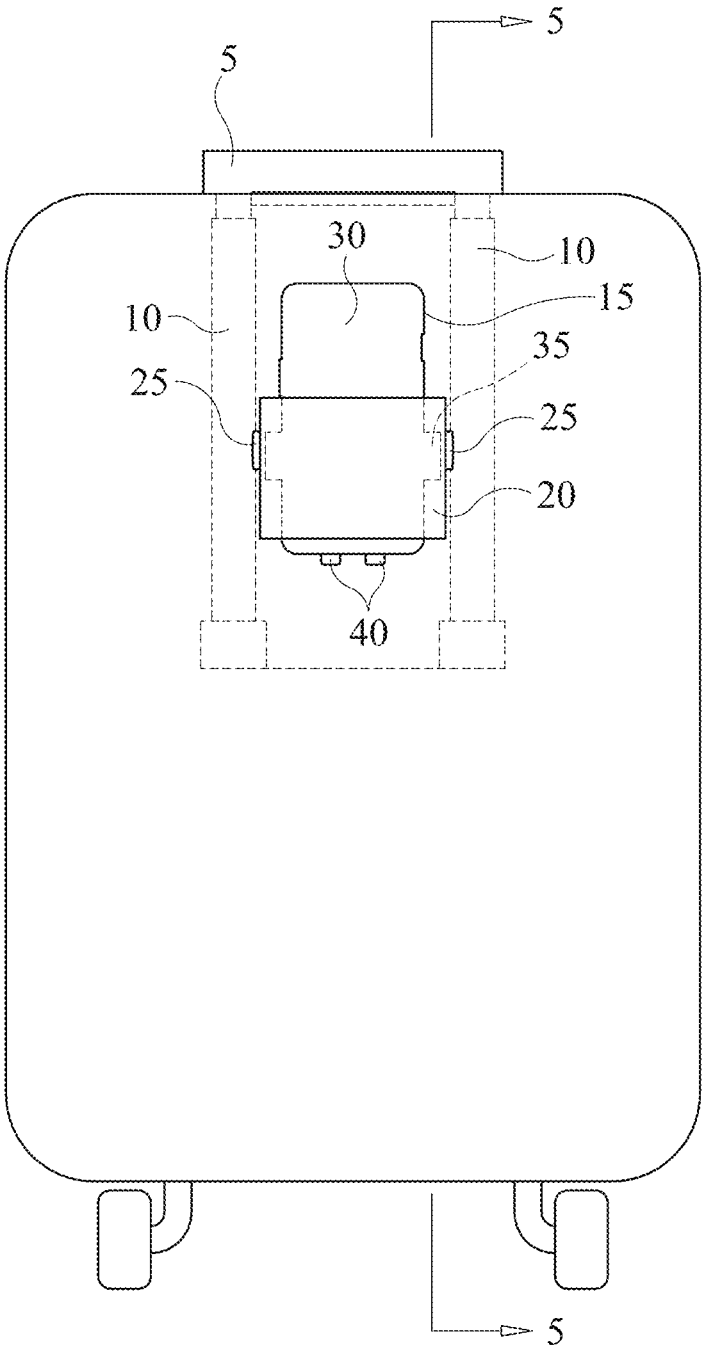
FIG. 4 is a back view of a piece of luggage depicting the cell phone and carrier stowed within the luggage.
Figure 5:
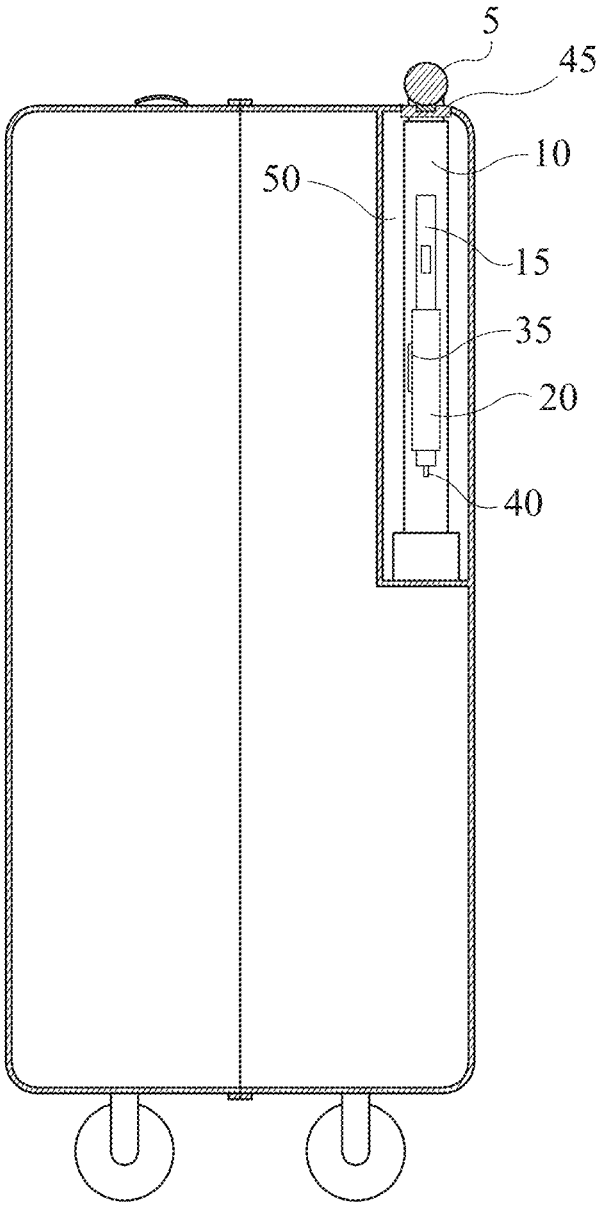
FIG. 5 is a side view of the interior compartment of the luggage depicting the storage space for the cell phone holder.

When the cell phone 30 is placed in the holder 20 the cell phone 30 may be stowed within the luggage such as depicted in FIG. 4.

While the embodiments of the invention have been disclosed, certain modifications may be made by those skilled in the art to modify the invention without departing from the spirit of the 22 invention.

The inventor claims:

1. A cell phone storage device embedded in luggage which is comprised of:

a piece of luggage,
wherein the piece of luggage is a predetermined shape,
wherein the piece of luggage has defined sides,
wherein the piece of luggage has a top surface,
wherein the piece of luggage has a bottom surface,
wherein the piece of luggage provides an interior cavity to stow luggage;
a luggage handle,
wherein the luggage handle is used to pull the luggage,
a pair of telescoping handles,
wherein the pair of telescoping handles are attached to the luggage handle,
wherein the pair of telescoping handles are stowed in the interior cavity of the piece of luggage,
a cell phone holder,
wherein the cell phone holder is placed between the pair of telescoping handles,
wherein the cell phone holder stows a cell phone;
wherein a second cavity is provided within the interior of the piece of luggage to stow the cell phone holder;
wherein the second cavity has defined walls;
wherein the second cavity is a predetermined size;
wherein the size of second cavity can house a cell phone;
wherein the second cavity is integral with the piece of luggage;
said second cavity remains stationary within the piece of luggage;
said second cavity is separate from the interior cavity for the luggage;
wherein the cell phone holder is encased within the second cavity of the piece of luggage when the luggage handle is flush with the top surface of the luggage;
wherein the cell phone is secured to the cell phone holder within the second cavity of the piece of luggage when the luggage handle is flush with the top surface of the luggage;
wherein the cell phone holder is secured to the pair of telescoping handles,
wherein the cell phone holder can rotate,
a phone cover,
wherein the phone cover is a predetermined size,
a pair of side clamps are placed on the side of the phone cover,
a pair of leg clamps are placed on an edge of the phone cover,
an opening on the top of the luggage,
wherein the opening is a predetermined size,
wherein the second cavity allows a cell phone to be stowed in the interior cavity of the luggage.

2. The cell phone storage device embedded in the luggage of claim 1, further comprises wherein the cell phone can rotate.

3. The cell phone storage device embedded in the luggage of claim 1, further comprises wherein the rotation of the phone holder can be locked in place.

* * * * *